US005443158A

United States Patent [19]

McKenny et al.

[11] Patent Number: 5,443,158

[45] Date of Patent: Aug. 22, 1995

[54] COAL FLOTATION PROCESS

[75] Inventors: Colin J. McKenny; Brian W. Raymond, both of Calgary, Canada

[73] Assignee: Fording Coal Limited, Calgary, Canada

[21] Appl. No.: 955,471

[22] Filed: Oct. 2, 1992

[51] Int. Cl.[6] ..... B03B 1/04; B03D 1/02

[52] U.S. Cl. ..... 209/166; 252/61

[58] Field of Search ..... 209/166, 167, 9; 252/61

[56] References Cited

U.S. PATENT DOCUMENTS

| | | |
|---|---|---|
| H 000,458 | 4/1988 | Turner, Jr. . |
| 2,028,742 | 1/1936 | Frantz . |
| 4,171,261 | 10/1979 | Dorrepaal et al. . |
| 4,186,083 | 1/1980 | Wang et al. . |
| 4,196,092 | 4/1980 | Wang et al. . |
| 4,270,926 | 6/1981 | Burk . |
| 4,305,815 | 12/1981 | Hefner, Jr. . |
| 4,308,132 | 12/1981 | McCarthy . |
| 4,308,133 | 12/1981 | Meyer . |
| 4,347,126 | 8/1982 | McGarry et al. . |
| 4,347,127 | 8/1982 | Duttera et al. . |
| 4,372,864 | 2/1983 | McCarthy . |
| 4,415,337 | 11/1983 | Kutta . |
| 4,416,769 | 11/1983 | McCaffrey et al. . |
| 4,452,714 | 6/1984 | McCarthy . |
| 4,474,619 | 10/1984 | Meyer et al. . |
| 4,504,385 | 3/1985 | Keys . |
| 4,514,292 | 4/1985 | Burdick . |
| 4,526,680 | 7/1985 | Owen . |
| 4,532,032 | 7/1985 | Ng et al. . |
| 4,589,980 | 5/1986 | Keys . |
| 4,597,857 | 7/1986 | Norrgran et al. . |
| 4,597,858 | 7/1986 | Burgess et al. . |
| 4,601,818 | 7/1986 | Bresson et al. . |
| 4,632,750 | 12/1986 | McGarry . |
| 4,659,458 | 4/1987 | Chin et al. . |
| 4,678,561 | 7/1987 | Keys . |
| 4,678,562 | 7/1987 | Keys . |
| 4,744,890 | 5/1988 | Miller et al. . |
| 4,838,434 | 6/1989 | Miller et al. . |
| 4,857,221 | 8/1989 | Brooks et al. . |
| 4,886,522 | 12/1989 | Davidson . |
| 4,892,648 | 1/1990 | Kulkarni . |
| 4,913,805 | 4/1990 | Chin . |
| 4,950,390 | 8/1990 | Szentlaszloi et al. . |
| 4,966,687 | 10/1990 | Trigg . |
| 4,981,582 | 1/1991 | Yoon et al. . |
| 5,096,572 | 3/1992 | Hwang . |

FOREIGN PATENT DOCUMENTS

| | | |
|---|---|---|
| 0106787 | 4/1984 | European Pat. Off. . |
| 2099727 | 12/1982 | United Kingdom . |
| 1318304 | 6/1987 | U.S.S.R. . |

OTHER PUBLICATIONS

Aplan, F. F., "Coal Properties Dictate Flotation Strategies", *Mining Engineering*, Jan. 1993, pp. 83–96.

*Primary Examiner*—Thomas M. Lithgow
*Attorney, Agent, or Firm*—Rodman & Rodman

[57] ABSTRACT

A process for the flotation of particles of lignitic coal, subbituminous coal or oxidized bituminous coal contained within a slurry of coal and gangue, comprising the steps of dispersing a surfactant throughout the slurry, first conditioning the slurry such that the surfaces of the particles of coal are selectively coated by the surfactant to produce activated particles of coal, dispersing an oil throughout the slurry, second conditioning the slurry such that the surfaces of the activated particles of coal are selectively coated by the oil to produce oiled particles of coal, and floating the oiled particles of coal on the surface of the slurry for separation from the slurry and gangue.

48 Claims, No Drawings

COAL FLOTATION PROCESS

TECHNICAL FIELD

The present invention relates to an improved process for selectively floating particles of coal contained within a slurry of coal and gangue in order to separate the particles of coal from the gangue and the slurry.

BACKGROUND ART

The separation of fine particles of coal contained in a coal slurry through the use of froth flotation processes is well known. Froth flotation processes involve introducing air into the coal slurry. The hydrophobic particles of coal are contacted with finely disseminated air bubbles such that the fine air bubbles become adhered to the hydrophobic coal particles. The surface tension of the air bubble is such that small particulates, typically those less than a particle size of 28 mesh X 0, readily attach themselves. The particle carrying bubbles are then permitted to rise, forming a froth on the surface of the slurry. The froth, containing the hydrophobic particles of coal, is skimmed from the surface of the slurry and collected, while rejecting any hydrophilic particles of impurities which do not adhere to the air bubbles and which remain suspended in the slurry. These processes are generally described in the texts *An Introduction to the Theory of Flotation*, V. I. Klassen and V. A. Mokrousov, Butterworths, 1963, and *Froth Flotation*, 50th Anniversary Volume, D. Furstenau, AIME, 1962.

Flotation of coal fines has become increasingly important as a separation and cleaning process where there is a lowering in both the particle size and grade of the coal being recovered from mining operations. The ability to remove the coal fines from coal washery waters or tailings is also advantageous in order to recover coal fines missed by other techniques of coal recovery.

In order to improve the selectivity and recovery of the flotation process and enhance floating of the coal fines, various types of reagents have been developed for addition to the slurry. Frothers and collectors are two types of reagents which are commonly used in coal flotation.

The purpose of a frother is to facilitate the production of a more stable froth which is better able to carry the particles of coal on the surface of the slurry until the froth is removed. Stability is improved because the frother enhances the attachment of the air bubble to the coal particles. Most high rank coals are naturally floatable due to the hydrophobic nature of their surfaces, which causes them to be attracted to the air bubbles. Therefore flotation of high rank coals may generally be effected with the use of a conventional frother alone. However, oxidized bituminous and low rank coals tend to be more hydrophilic in nature and therefore are difficult or impossible to float, because the coal particles are less attracted to the air bubbles. Attempts have been made to develop frothers more suited for flotation of these types of coals. For example, U.S. Pat. No. 4,504,385 issued Mar. 12, 1985 to Keys is directed towards an improved alcohol frother, and U.S. Pat. No. 4,308,133 issued Dec. 29, 1981 to Meyer is directed towards a froth promoter which is added contemporaneously to the slurry with the frother in order to enhance the formation of the froth on the surface of the slurry.

Collectors are used in conjunction with frothers and are intended to aid in floating those coals which are less hydrophobic in nature and therefore less readily floated. The basic purpose of a collector is to render the surfaces of the particles of coal more hydrophobic such that the particles of coal and the rising air bubbles which are coated with the frother have greater contact and adhesion. The collector is generally selective in that it selectively adheres to and preferentially wets the surfaces of the particles of coal but not the particles of impurities and other matter contained in the slurry. Collectors are usually a hydrocarbon oil. Diesel fuel, fuel oil and kerosene are the most widely used. Attempts have been made to improve the effectiveness of the collector. Examples of patents directed at improved collectors include U.S. Pat. No. 4,416,769 issued Nov. 22, 1983 to McCaffrey et. al., U.S. Pat. No. 4,526,680 issued Jul. 2, 1985 to Owen, and U.S. Pat. No. 4,532,032 issued Jul. 30, 1985 to Ng et. al.

Despite the use of frothers and collectors, as coal becomes more oxidized or of a lower rank, it becomes more hydrophilic and less easy to float. As a result, if a collector or frother is utilized with oxidized or low rank coals, relatively large quantities are required to float the particles of coal and flotation is not optimum.

To improve the flotation of particles of coal which have a more hydrophilic nature, other types of reagents have been developed which are usually used in conjunction with collectors and frothers. U.S. Pat. No. 4,589,980 issued May 20, 1986 to Keys, and U.S. Pat. No. 4,678,561 and 4,678,562 issued Jul. 7, 1987 to Keys are directed at the addition of a reagent, referred to as a "promoter", to the slurry along with a collector and a frother. The promoter is comprised of a non-ionic, hydrophobic, non-emulsified, aliphatic ester of an at least 10 aliphatic carboxylic acid which is devoid of nitrogen and sulphur atoms or the carboxylic acid itself. Once all of the reagents are added, the slurry is conditioned by vigorously mixing or agitating the slurry prior to flotation.

Similarly, other processes combine the collector and the frother with other reagents to form a product which is then added to the slurry and dispersed into the slurry in a single agitation or mixing process step. Examples include U.S. Pat. No. 4,632,750 issued Dec. 30, 1986 to McGarry, U.S. Pat. No. 4,857,221 issued Aug. 15, 1989 to Brookes et. al., U.S. Pat. No. 4,305,815 issued Dec. 15, 1981 to Hefner, Jr., U.S. Pat. No. 4,308,132 issued Dec. 29, 1981 to McCarthy, U.S. Pat. No. 4,372,864 issued Feb. 8, 1983 to McCarthy, U.S. Pat. No. 4,452,714 issued Jun. 5, 1984 to McCarthy, and U.S. Pat. No. 4,474,619 issued Oct. 2, 1984 to Meyer et. al.

The processes which have been developed tend not to be very selective, are uneconomical, and are therefore not widely used. There is therefore a need in the industry for a process for floating particles of oxidized bituminous and low ranked coals contained in a coal slurry in an economical manner using conventional coal flotation techniques.

DISCLOSURE OF INVENTION

The present invention relates to a process for selectively floating particles of coal contained within a slurry of coal and gangue, where the coal is a lower rank lignitic or subbituminous coal or an oxidized bituminous coal that is difficult or impossible to float using heretofore conventional methods. The process involves selectively coating the surfaces of the coal particles with a surfactant to render them more oleophilic, and then, in a separate discrete step, coating the activated coal with oil to make the coal easier to float.

More specifically, the invention is comprised of a process for selectively floating particles of lignitic coal, subbituminous coal or oxidized bituminous coal contained within a slurry of coal and gangue, comprising the steps of: dispersing a quantity of a surfactant throughout the slurry; first conditioning the slurry such that the surfaces of the particles of coal are selectively coated by the surfactant to produce activated particles of coal; dispersing a quantity of an oil throughout the slurry; second conditioning the slurry such that the surfaces of the activated particles of coal are selectively coated by the oil to produce oiled particles of coal; and floating the oiled particles of coal on the surface of the slurry for separation from the slurry and the gangue, where the surfactant is a substance that will selectively adhere to the coal and not the gangue, and will cause the coal to accept a coating of the oil.

The process may further comprise the step of maintaining the pH of the slurry throughout the process in the range of about 6 to 9. The floating step may be performed using a frother which is dispersed throughout the slurry to enhance the floating of the oiled particles of coal on the surface of the slurry.

The surfactant may be selected from the group consisting of polydimethylsiloxane, oleic acid, lignansulphonates, eucalyptus oil and fatty acids having chain lengths of less than 15 carbon atoms, sold under the trademark SHUR-COAL 168 (O'Brien Industries, Inc., Twinsburg, Ohio), and vegetable oils, or from the group consisting of fatty acid esters, fatty acid ester condensation products, fatty acid condensation products, hydroxylated ether amine, a bis (aklyl) ester of a sulphosuccinic acid salt, fatty sulphosuccinates, hydroxy or chloro or sulphide derivative of a methyl or ethyl ester of caproic acid, salts of napthenic acids, salts of cresylic acids, salts of rosin acids, aliphatic esters of an aliphatic carboxylic acid having chain lengths of at least 10 carbon atoms, oxified derivatives of fatty acids and fatty acids having chain lengths of greater than 14 carbon atoms. Less than about 0.25 kilograms of surfactant may be utilized for each tonne of dry coal, except where the surfactant is oleic acid, in which case less than about 3.0 kilograms of surfactant may be utilized for each tonne of dry coal. The oil may be a heavy oil or a light oil selected from the group consisting of used motor oil, diesel, kerosene and bunker C oil. The oil may be comprised of a blend including an amount of a heavy oil. A quantity of oil of less than about 2% by dry weight of coal may be dispersed throughout the slurry. The dispersability of the surfactant may be enhanced prior to dispersing it throughout the slurry. The dispersability of the surfactant may be enhanced by diluting, heating, or agitating it. The diluent may be a light oil. The dispersability of the oil may be enhanced prior to dispersing it throughout the slurry. The dispersability of the oil may be enhanced by heating, agitating or emulsifying it. The particles of coal may have a size of less than about 28 mesh X 0.

Specific embodiments of the invention will now be described in the paragraphs that follow.

BEST MODE OF CARRYING OUT INVENTION

The present invention comprises a process for selectively floating particles of coal contained within a slurry of coal and gangue, where the coal is of a type which is difficult or impossible to float using heretofore conventional methods. Although coal as a naturally occurring substance may exhibit a wide range of characteristics even amongst specimens of the same broad class, it has been found that the lower the rank of the coal, or the more oxidized the coal is, the more difficult it is to float using conventional methods. As a result, the process of the present invention is most advantageously used with low rank lignitic and subbituminous coals and oxidized bituminous coals which exhibit poor floating properties. Such coals also tend to have a low Free Swelling Index ("FSI"). FSI is a measure of the caking characteristics of the coal or its ability to stick together while being heated. Coals with an FSI greater than about 3, typically bituminous coals, generally readily float, while coals with an FSI less than 3 have a tendency to be more difficult to float. Consequently, the process of the present invention may also be advantageously used with coals having an FSI less than about 3.

As indicated above, the process of this invention is directed at selectively floating coal particles so as to separate them from both the slurry and from the gangue which is contained within the slurry. Gangue is defined for the purposes of this patent to be any undesirable, unwanted or uneconomical constituent contained within the slurry, and may include low quality (high ash) carbonaceous material as well as shale, clay, and other non-carbonaceous impurities. The determination of what constitutes coal and what constitutes gangue will depend upon the desired selectivity of the process, which can be controlled by the choice of surfactant.

In addition, the particles of coal to be floated in the process are preferably of a size no greater than about 28 mesh X 0. Larger particles are not readily lifted by the air bubbles during flotation and are also large enough to be separated by other techniques including conventional separation processes.

The particles of coal and gangue should be combined with a sufficient amount of a liquid to produce a slurry. The liquid is preferably water, thus producing a water slurry containing particles of coal and gangue. The water may be pure water, waste water or water that has been recycled from prior processes. The slurry may contain up to 35% by weight of solids, however, it is more typical for the slurry to contain in the range of 2.5% to 10% by weight of solids.

The process is comprised of the following steps: dispersing a surfactant throughout the slurry; first conditioning the slurry to produce activated particles of coal; dispersing an oil throughout the slurry; second conditioning the slurry to produce oiled particles of coal; and floating the oiled particles of coal.

The first step in the process is dispersing a quantity of a surfactant throughout the slurry for selective adhering to the particles of coal. The second step in the process is first conditioning the slurry such that the surfaces of the particles of coal are substantially coated by the surfactant to produce activated particles of coal.

The coals being used in the process are generally hydrophilic. They do not therefore readily float using conventional techniques. However, because these coals are also generally oleophobic, oil cannot simply be added to render the coal hydrophobic since the oil will tend to be repelled by the particles of coal. Therefore, the surfactant is necessary to act as an activator on the coal surface to which the oil will more readily adhere. In order to achieve the desired effect in the most economical manner, the surfactant and the oil should be dispersed and conditioned into the slurry separately, since the oil will otherwise tend to adsorb or absorb the surfactant.

The surfactant is chosen to selectively adhere to the particles of coal in the slurry and not to the gangue contained in the slurry, and is also chosen so as to attract the oil to be added later in the process. As a result, surfactant is defined for the purpose of this disclosure and the appended claims to be any substance which will selectively adhere to the coal in the slurry without adhering to the gangue in the slurry, and which will cause the coal particles to accept a coating of the oil which is to be added later. Because every type of coal is different, and will exhibit different surface chemistry, no single surfactant will function satisfactorily with every coal. It is therefore necessary to experiment in order to determine the best choice of surfactant for each particular coal. It has been found that preferred surfactants include polydimethylsiloxane, oleic acid, lignansulphonates, eucalyptus oil, fatty acids having chain lengths of less than 15 carbon atoms, SHUR-COAL 168 (trade-mark), and vegetable oils. However, the surfactant may also be chosen from the group consisting of fatty acid esters, fatty acid ester condensation products, fatty acid condensation products, hydroxylated ether amine, a bis (aklyl) ester of a sulphosuccinic acid salt, fatty sulphosuccinates, hydroxy or chloro or sulphide derivative of a methyl or ethyl ester of caproic acid, salts of napthenic acids, salts of cresylic acids, salts of rosin acids, aliphatic esters of an aliphatic carboxylic acid having chain lengths of at least 10 carbon atoms, oxified derivatives of fatty acids and fatty acids having chain lengths of greater than 14 carbon atoms.

It is believed that the surfactant changes the surface chemistry of the particles of coal so that the particles of coal are rendered more oleophilic. In the present process, the quantity of surfactant to be used should ideally be an amount sufficient to provide only a thin coating of surfactant over substantially all surfaces of the particles of coal. Thicker layers of surfactant may be used, but result in a greater amount of surfactant being used in the process, and therefore render the process less economical. It has been found that for surfactants other than oleic acid, the minimum required amount of surfactant may be as little as 0.075 to 0.125 kilograms of surfactant per tonne of dry coal, but preferably, less than about 0.25 kilograms of surfactant per tonne of dry coal is used. Where oleic acid is used as a surfactant, the minimum required amount may be as high as 3 kilograms per tonne of dry coal. In any event, the amount of surfactant required to add to the slurry in order to substantially coat the particles of coal is generally less than that required in other processes where all of the reagents are added in a single step to the slurry. It is important that the surfactant be well dispersed throughout the slurry. This may be accomplished by dispersing techniques known in the art, such as by using mechanical mixers, agitators, in line mixers, liquid/liquid eductors, steam blasting through liquid/steam eductors, or other conventional methods.

Once the surfactant has been dispersed throughout the slurry, the second step of the process is the first conditioning of the slurry. First conditioning of the slurry involves mixing or agitating the slurry. The slurry may be conditioned using mechanical mixers or agitators, in line mixers, liquid/liquid eductors, steam blasting through liquid/steam eductors, or any other conventional mixing method.

The slurry is conditioned so that the surfaces of the particles of coal are selectively and substantially coated by the surfactant. It is important that the surfactant has been well dispersed throughout the slurry in order to maximize the effect of the surfactant on the coal and to minimize the amount of surfactant required. As stated, only a thin layer or coating of surfactant is necessary to activate the particles of coal, producing activated particles of coal. Activated particles of coal are particles of coal having a coating of the surfactant. Surfactants when used on their own do not necessarily improve the flotation of the coal particles because they may not be readily attracted to frothers, where a frother is utilized. The activated particles of coal are, however, generally oleophilic and thus attracted to the oil added in the next step.

Since oil is generally attracted to air bubbles and frothers and will also tend to adhere to the activated particles of coal, the third step in the process is to disperse a quantity of an oil throughout the slurry for selective adhering to the activated particles of coal. Once the oil has been dispersed throughout the slurry, the fourth step of the process is second conditioning of the slurry so that the surfaces of the activated particles of coal are substantially coated by the oil to produce oiled particles of coal.

The oil to be used in the third step may be a heavy oil or may be a light oil such as used motor oil, diesel, kerosene or bunker C oil. Heavy oil is considered to be oil having an API gravity of less than 15. However, the oil is preferably either all heavy oil or is a blend of heavy oil and light oil, such as a 50/50 blend of heavy oil and used motor oil. Use of an amount of heavy oil is preferred because heavy oil contains a high amount of asphaltenes and aromatics which are believed to enhance the selective attraction of the oil to the activated coal particles.

The quantity of oil to be dispersed throughout the slurry should ideally be an amount sufficient to provide only a thin coating of oil on substantially all surfaces of the activated particles of coal. Thicker layers of oil may be used, but result in a greater amount of oil being used in the process, and therefore render the process less economical. The quantity of oil added may be as great as 6% or more by weight of the activated particles of coal but is preferably less than 2% by weight of dry coal. Generally, the amount of oil required to be added in order to substantially coat the activated particles of coal is less than that required by other processes where all the reagents are added in a single step. It is important that the oil be well dispersed throughout the slurry. This may be accomplished by dispersing techniques known in the art, such as by using mechanical mixers, agitators, in line mixers, liquid/liquid eductors, steam blasting through liquid/steam eductors, or other conventional methods.

Once the oil has been dispersed throughout the slurry, the fourth step of the process is the second conditioning of the slurry. Second conditioning of the slurry may be performed in the same manner and may utilize the same type of apparatus as for the first conditioning of the slurry. The slurry should be sufficiently conditioned the second time in order to coat substantially all surfaces of the particles of the activated coal with the oil to produce oiled particles of coal. Oiled particles of coal are activated particles of coal having a coating of the oil. As stated, only a thin layer or coating of oil is necessary. It is important that the oil has been well dispersed throughout the slurry in order to maximize the effect of the oil on the activated particles of coal and to minimize the amount of oil required. The oiled particles of coal are more readily floated, and tend to be more readily attracted to frothers where a frother is utilized.

It is important that the first four steps of the process are performed separately, as discrete consecutive steps, for several reasons. Where the surfactant and the oil are added contemporaneously to the slurry, a greater quantity of each of these substances is generally required. The various reagents may react with each other resulting in reduced efficiency of each reagent. As well, for maximum efficiency, distinct layers or coatings of the reagents should be placed on the particles of coal in the specified order to achieve the desired surface chemistry. If these layers are not placed on the particles of coal separately, each reagent cannot perform its function to maximum capacity. For instance, if the particles of coal are not properly coated with the surfactant prior to adding the oil or the frother, the surfactant could be adsorbed or absorbed by the oil due to the high affinity of the surfactant to the oil. In addition, if the particles of coal are not first substantially coated with the surfactant, the coal will not become activated. If the coal is not activated, it will not be attracted to the oil and an amount of loose, unattached oil may float on the surface of the slurry. Finally, if all reagents are added at once, the time required for properly conditioning the slurry to achieve the desired coatings on the particles of coal may be increased.

Dispersion of the surfactant and the oil throughout the slurry are important to the proper conditioning of the slurry in the first and second conditioning steps respectively. Where the surfactant or the oil are of high viscosity, it may be necessary to enhance their dispersability prior to adding them to the slurry. To enhance the dispersability of the surfactant, it may be diluted with a light oil, it may be heated or it may be agitated using means well known in the art. To enhance the disperability of the oil, it may be diluted by altering the blend between heavy oil and lighter oils, it may be heated, or it may be agitated using means well known in the art. The oil may also be emulsified with the aid of a dispersing agent, which may include the following chemicals: deoxygenated caustic 0.1% solution; ethoxylated nonylphenols as a group, as sulphates or as amines; sodium lauryl sulphate; sodium dodecyl sulphate; and humic acids. The use of chemicals for dispersion is known in the art and described in Canadian Pat. No. 1,132,474; Canadian Pat. No. 1,143,313; Canadian Pat. No. 1,124,611; Canadian Pat. No. 1,157,411; Canadian Pat. No. 1,156,902; and U.S. Pat. No. 4,355,651.

Following the second conditioning of the slurry, the fifth step in the process is floating of the oiled particles of coal on the surface of the slurry for separation from the gangue and the slurry. Flotation of the oiled particles of coal is conducted using conventional flotation techniques, apparatus and coal flotation circuits. The oiled particles of coal are more readily attracted to the air bubbles and are floated to the surface as a froth. The froth is then skimmed from the slurry and cleaned.

In order to enhance the floating of the oiled particles of coal on the surface of the slurry, a quantity of a frother is preferably dispersed throughout the slurry prior to the floating step. The frother enhances the adherence of the air bubbles to the oiled particles of coal. Any conventional frother known in the art may be used, such as are described in the texts *Froth Flotation,* 50th Anniversary Volume, D. Furstenau, AIME, 1962, and An *Introduction to the Theory of Flotation*, V.I. Klassen and V. A. Makrousov, Butterworths, 1963. However, the preferred frothers are selected from the group consisting of methylisobutylcarbanol, pine oil, aliphatic alcohols having chain links of 5 to 8 carbon atoms, heptanols, octanols, capryl alcohol-octanol-2,creosote, cresylic acids, eucalyptus oil, and Dowfroth 1012 (trade-mark).

The quantity of frother used is determined by conventional flotation principles. A quantity of less than about 0.15 kilograms per tonne of particles of oiled coal is typically required, however, the quantity can range up to about 0.25 kilograms per tonne of coal and more. Where dispersion of the frother is difficult, the frother may be diluted with kerosene or diesel fuel at ratios up to 8:1.

Finally, it is preferable to maintain the pH of the slurry throughout the process in the range of about 6 to 9. The surface chemistry of the particles of coal varies with the pH of the slurry, which affects the effectiveness of the reagents, and in particular, the surfactant. The pH range of about 6 to 9 has been found to result in the most effective use of the surfactant and the other reagents by ensuring that the slurry is neither extremely acidic nor extremely basic. The lower the pH, the more positive the charge on the particles of coal and acidic the slurry. The higher the pH, the more negative the charge on the particles of coal and basic the slurry. The pH may then be adjusted to maintain it within the desired range. The pH may be adjusted using a pH adjusting composition, being either an alkyline material such as caustic soda, soda ash, lime, ammonia, potassium hydroxide or magnesium hydroxide, or an acidic material such as sulfuric acid, a carboxylic acid or a mineral acid.

It should be understood that the exact nature of the surface chemistry involved throughout this process is not completely known. Therefore the practice of this invention is not to be taken as limited by the theories contained herein.

The following examples serve to more fully illustrate the invention. During the test program, the following parameters were held constant:

| | |
|---|---|
| Slurry pulp density | 10% by wt. solids |
| Surfactant mixing time | 1 minute |
| Conditioning Time | 2 minutes |
| Frother (MIBC) addition rate | 0.2 kg/tonne |
| Flotation Time | 3 minutes |

NOTES:
When "50/50" is indicated, it means a blend of 50% Elk Point Heavy Oil with 50% used motor oil, emulsified.
Rates of additives of surfactant and diluents are expressed in kilograms per tonne based on dry weight of coal.
Rates of addition of oil are expressed in percentage based upon dry weight of coal.

The results of the test program relating to Example 1 through Example 6 are set below in tabular form.

EXAMPLE #

Flotation of Genesee, Ardley Formation Coal, subbituminous C, 17.2% feed ash, 20% moisture, FSI 0.

| Run Number | Surfactant | Oil | Product Ash % | Recovery % |
|---|---|---|---|---|
| 1 | 0.25 kg/tonne polydimethyl-siloxane (PDS) combined with 3.75 kg/ tonne kerosene | 4% Elk Point Heavy oil | 10.1 | 91.7 |
| 2 | 0.25 kg/tonne PDS combined with 3.75 kg/tonne kerosene | 4% Elk Point Heavy oil at 30° C. | 9.6 | 81.5 |
| 3 | 0.25 kg/tonne PDS combined with 3.75 kg/tonne kerosene | 2% Elk Point Heavy Oil at 30° C. | 10.4 | 83.0 |
| 5 | 0.25 kg/tonne PDS combined with 3.75 kg/tonne kerosene | None used | 10.7 | 14.6 |
| 4 | None used | None used | — | -0- |
| 7 | 0.9 kg/tonne Eucalyptus Oil | 2% Elk Point Heavy Oil | 11.1 | 83.1 |
| 10 | 0.25 kg/tonne Eucalyptus Oil | 2% Elk Point Heavy Oil | 9.8 | 72.2 |

EXAMPLE #2

Fording River Oxidized, medium volatile bituminous, 18.0% ash, 5% moisture, FSI 3.

| Run Number | Surfactant | Oil | Product Ash % | Recovery % |
|---|---|---|---|---|
| 16 | 0.25 kg/tonne PDS combined with 3.75 kg/tonne kerosene | 2% Elk Point Heavy Oil | 8.0 | 65.0 |
| 17 | 0.25 kg/tonne PDS combined with 3.75 kg/tonne kerosene | 2% Elk Point Heavy Oil | 8.6 | 66.6 |
| 48 | 0.45 kg/tonne C14 fatty acid | 2% 50/50 | 11.9 | 77.0 |
| 49 | 0.18 kg/tonne C14 fatty acid | 2% Elk Point Heavy Oil | 10.7 | 75.0 |
| 50 | 0.18 kg/tonne C14 fatty acid | 2% 50/50 | 10.5 | 73.3 |
| 69 | 0.25 kg/tonne Eucalyptus Oil | 2% 50/50 | 9.6 | 61.0 |
| 19 | None Used | None Used | — | -0- |
| 45 | 0.25 kg/tonne PDS combined with 3.75 kg/tonne kerosene | 2% diesel | 7.2 | 38.0 |

EXAMPLE #3

LP tailings pond coal, Fording River, 23.3% ash, wet, FSI 3.

| Run Number | Surfactant | Oil | Product Ash % | Recovery % |
|---|---|---|---|---|
| 15 | 0.25 kg/tonne PDS combined with 3.75 kg/tonne kerosene | 2% Elk Point Heavy Oil | 9.7 | 55.5 |
| 25 | 0.1 kg/tonne PDS combined with 3.75 kg/tonne kerosene | 2% Elk Point Heavy Oil | 10.7 | 59.6 |
| 20 | None Used | None Used | — | -0- |
| 27 | 0.25 kg/tonne PDS combined with 3.75 kg/tonne kerosene | 2% Elk Point Heavy Oil | 13.6 | 93.8 |
| 43 | 0.25 kg/tonne PDS combined with 3.75 kg/tonne kerosene | 2% 50/50 | 15.2 | 95 |
| 52 | 0.25 kg/tonne C14 fatty acid | 2% 50/50 | 15.5 | 95 |
| 53 | 0.25 kg/tonne C14 fatty acid | 1% 50/50 | 14.9 | 94 |
| 63 | 0.1 kg/tonne C14 fatty acid | 1% 50/50 | 15.8 | 87.2 |
| 73 | 0.18 kg/tonne C14 fatty acid | 1% 50/50 | 12.5 | 80.4 |
| 93 | 0.25 kg/tonne Eucalyptus oil | 1% 50/50 | 12.6 | 73.9 |

EXAMPLE #4

NP tailings pond coal, Fording River, 41.5% ash, MV bituminous, wet, FSI 3.

| Run Number | Surfactant | Oil | Product Ash % | Recovery % |
|---|---|---|---|---|
| 14 | 0.25 kg/tonne PDS combined with 3.75 kg/tonne kerosene | 2% Elk Point Heavy Oil | 17.2 | 55.8 |
| 39 | 0.25 kg/tonne PDS combined with 3.75 kg/tonne kerosene | 2% Elk Point Heavy Oil | 17.8 | 65.2 |

-continued

| Run Number | Surfactant | Oil | Product Ash % | Recovery % |
|---|---|---|---|---|
| | (with freshly ground coal) | | | |
| 24 | 0.25 kg/tonne Eucalyptus Oil | 2% Elk Point Heavy Oil | 16.3 | 48.9 |
| 92 | 0.25 kg/tonne Eucalyptus Oil combined with 2.8 kg/tonne kerosene | 2% 50/50 | 20.8 | 66.9 |
| 119 | 0.1 kg/tonne Eucalyptus Oil | 0.4% 50/50 | 19.4 | 56.8 |
| 104 | 0.25 kg/tonne sodium lignansulphonate | 2% 50/50 | 21.0 | 63.8 |
| 136 | 0.1 kg/tonne Shur-coal 168 | 0.4% 50/50 | 19.1 | 56.3 |
| 20 | None Used | None Used | — | -0- |

EXAMPLE #5

Fording River MV bituminous, 17.7% ash, 5% moisture, FSI 3.

| Run Number | Surfactant | Oil | Product Ash % | Recovery % |
|---|---|---|---|---|
| 16 | 0.25 kg/tonne PDS combined with 3.75 kg/tonne kerosene | 2% Elk Point Heavy Oil | 8.0 | 65.0 |
| 17 | 0.25 kg/tonne PDS combined with 3.75 kg/tonne kerosene | 2% Elk Point Heavy Oil | 8.6 | 66.6 |
| 69 | 0.25 kg/tonne Eucalyptus Oil | 2% 50/50 | 9.6 | 61.0 |
| 71 | 0.1 kg/tonne C14 fatty acid | 2% 50/50 | 11.3 | 72.6 |
| 18 | 0.25 kg/tonne PDS combined with 3.75 kg/tonne kerosene | 4% motor oil | 7.4 | 51.2 |
| 23 | 0.25 kg/tonne PDS combined with 3.75 kg/tonne kerosene | 2% motor oil | 11.2 | 28 |
| 108 | 0.25 kg/tonne C14 fatty acid (surfactant and oil added to slurry simultaneously) | 2% 50/50 | 7.3 | 29 |
| 45 | 0.25 kg/tonne PDS (surfactant and oil added to slurry simultaneously) | 2% diesel | 7.2 | 38 |

EXAMPLE #6

Highly Oxidized Fording Coal, bituminous,—18% ash, FSI 0.

| Run Number | Surfactant | Oil | Product Ash % | Recovery % |
|---|---|---|---|---|
| 111 | 0.25 kg/tonne Shur-coal 168 | 2% 50/50 | 7.6 | 85 |
| 112 | 3.0 kg/tonne Oleic acid | 2% 50/50 | 6.5 | 64 |
| 125 | 0.25 kg/tonne Shur-coal 168 combined with 2.8 kg/tonne kerosene | 2% 50/50 | 7.3 | 79 |
| 142 | 0.25 kg/tonne Shur-coal 168 combined with 2.8 kg/tonne kerosene | 2% 50/50 | 7.1 | 69.7 |
| 143 | 0.25 kg/tonne Shur-coal 168 combined with 2.8 kg/tonne kerosene | 2% 50/50 | 7.7 | 75.5 |
| 144 | 0.56 kg/tonne Shur-coal 168 combined with 2.8 kg/tonne kerosene | 2% 50/50 | 10.9 | 65 |

The embodiments of the invention in which an exclusive property or privilege is claimed are defined as follows:

1. A process for selectively floating particles of lignitic coal, subbituminous coal or oxidized bituminous coal contained within a slurry of coal and gangue, comprising the following steps in the sequence set forth:

(a) dispersing a quantity of a surfactant throughout the slurry;

(b) first conditioning the slurry in the presence of said quantity of surfactant by mixing or agitating such that the surfaces of the particles of coal are selectively coated by the surfactant to produce more oleophilic activated particles of coal;

(c) dispersing a quantity of an oil selected from the group consisting of heavy oil and bunker C oil throughout the first conditioned slurry containing the surfactant coated, more oleophilic, activated particles of coal;

(d) second conditioning the first conditioned slurry in the presence of said quantity oil by mixing or agitation such that the surfaces of the surfactant coated, more oleophilic , activated particles of coal are selectively coated by the oil to produce oiled particles of coal; and (e) subjecting the second conditioned slurry to selective flotation in the presence of gas bubbles to selectively float the oiled particles of coal on the surface of the slurry for separation from the slurry and the gangue;

where the surfactant is a substance that will selectively adhere to the coal and not the gangue, and will cause the coal to accept a coating of the oil.

2. The process as claimed in claim 1 further comprising the step of maintaining the pH of the slurry throughout the process in the range of about 6 to 9.

3. The presence as claimed in claim 1 wherein the step of flotation is performed in the presence of a frother which is dispersed throughout the slurry to enhance the floating of the oiled particles of coal on the surface of the slurry.

4. The process as claimed in claim 1 wherein the surfactant is selected from the group consisting of polydimethylsiloxane, oleic acid, lignansulphonates, eucalyptus oil, fatty acids having chain lengths of less than 15 carbon atoms, vegetable oil, and a mixture of propoxylated $C_{18}$ unsaturated fatty acids, trimethyl pentanediol monoisobutyrate, trimethyl pentanediol diisobutyrate and trimethyl pentanediol.

5. The process as claimed in claim 1 wherein the surfactant is selected from the group consisting of fatty acid esters, fatty acid ester condensation products, fatty acid condensation products, hydroxylated ether amine, a bis (alkyl) ester of a sulphosuccinic acid salt, fatty sulphosuccinates, hydroxy or chloro or sulphide derivative of a methyl or ethyl ester of caproic acid, salts of napthenic acids, salts of cresylic acids, salts of rosin acids, aliphatic esters of an aliphatic carboxylic acid having at least 10 carbon atoms, oxified derivatives of fatty acids and fatty acids having chain lengths of greater than 14 carbon atoms.

6. The process as claimed in claim 1 wherein the oil is blended with a light oil other than bunker C oil to form a blended oil prior to being dispersed throughout the first conditioned slurry in order to enhance its dispersability.

7. The process as claimed in claim 1, further comprising the step of enhancing the dispersability of the surfactant prior to dispersing it throughout the slurry.

8. The process as claimed in claim 7 wherein the dispersability of the surfactant is enhanced by diluting, heating, or agitating it.

9. The process as claimed in claim 8 wherein the surfactant is diluted by the addition of a light oil.

10. The process as claimed in claim 1, further comprising the step of enhancing the dispersability of the oil prior to dispersing it throughout the slurry.

11. The process as claimed in claim 10 wherein the dispersability of the oil is enhanced by heating, agitating or emulsifying it.

12. The process as claimed in claim 1 wherein the particles of coal have a size of no greater than about 28 mesh X 0.

13. The process as claimed in claim 4 wherein the surfactant is selected from the group consisting of polydimethylsiloxane, lignansulphonates, eucalyptus oil, fatty acids having chain lengths of less than 15 carbon atoms, vegetable oil, and a mixture of propoxylated $C_{18}$ unsaturated fatty acids, and trimethyl pentanediol monoisobutyrate, trimethyl pentanediol diisobutyrate and trimethyl pentanediol, and mixtures thereof and is present in a finite amount capable of performing its intended function up to an amount not exceeding about 0.25 kilograms for each tonne of dry coal.

14. The process as claimed in claim 4 wherein the surfactant comprises oleic acid and is present in a finite amount capable of performing its intended function up to an amount not exceeding about 3.0 kilograms for each tonne of dry coal.

15. The process as claimed in claim 5 wherein the surfactant is present in a finite amount capable of performing its intended function to an amount not exceeding about 0.25 kilograms for each tonne of dry coal.

16. The process as claimed in claim 1 wherein the quantity of oil is present in a finite amount capable of performing its intended function up to an amount not exceeding about 2% by dry weight of coal .

17. The process as claimed in claim 6 wherein the light oil that is blended with the oil is selected from the group consisting of used motor oil, diesel and kerosene.

18. The process as claimed in claim 6 wherein the quantity of blended oil is present in a finite amount capable of performing its intended function up to an amount not exceeding about 2% by dry weight of coal.

19. The process as claimed in claim 2 wherein the surfactant is selected from the group consisting of polydimethylsiloxane, oleic acid, lignansulphonates, eucalyptus oil, fatty acids having chain lengths of less than 15 carbon atoms, vegetable oil, and a mixture of propoxylated $C_{18}$ unsaturated fatty acids, trimethyl pentanediol monoisobutyrate, trimethyl pentanediol diisobutyrate and trimethyl pentanediol.

20. The process as claimed in claim 3 wherein the surfactant is selected from the group consisting of polydimethylsiloxane, oleic acid, lignansulphonates, eucalyptus oil, fatty acids having chain lengths of less than 15 carbon atoms, vegetable oil, and a mixture of propoxylated $C_{18}$ unsaturated fatty acids, trimethyl pentanediol monoisobutyrate, trimethyl pentanediol diisobutyrate and trimethyl pentanediol.

21. The process as claimed in claim 2 wherein the surfactant is selected from the group consisting of fatty acid esters, fatty acid ester condensation products, fatty acid condensation products, hydroxylated ether amine, a bis (alkyl) ester of a sulphosuccinic acid salt, fatty sulphosuccinates, hydroxy or chloro or sulphide derivative of a methyl or ethyl ester of caproic acid, salts of napthenic acids, salts of cresylic acids, salts of rosin acids, aliphatic esters of an aliphatic carboxylic acid having at least 10 carbon atoms, oxified derivatives of fatty acids and fatty acids having chain lengths of greater than 14 carbon atoms.

22. The process as claimed in claim 3 wherein the surfactant is selected from the group consisting of fatty acid esters, fatty acid ester condensation products, fatty acid condensation products, hydroxylated ether amine, a bis (alkyl) ester of a sulphosuccinic acid salt, fatty sulphosuccinates, hydroxy or chloro or sulphide derivative of a methyl or ethyl ester of caproic acid, salts of napthenic acids, salts of cresylic acids, salts of rosin acids, aliphatic esters of an aliphatic carboxylic acid having at least 10 carbon atoms, oxified derivatives of fatty acids and fatty acids having chain lengths of greater than 14 carbon atoms.

23. The process as claimed in claim 2 wherein the oil is blended with a light oil other than bunker C oil to form a blended oil prior to being dispersed throughout the first conditioned slurry in order to enhance its dispersability.

24. The process as claimed in claim 3 wherein the oil is blended with a light oil other than bunker C oil to form a blended oil prior to being dispersed throughout the first conditioned slurry in order to enhance its dispersability.

25. The process as claimed in claim 2 further comprising the step of enhancing the dispersability of the surfactant prior to dispersing it throughout the slurry.

26. The process as claimed in claim 3 further comprising the step of enhancing the dispersability of the surfactant prior to dispersing it throughout the slurry.

27. The process as claimed in claim 2 further comprising the step of enhancing the dispersability of the oil prior to dispersing it throughout the slurry.

28. The process as claimed in claim 3 further comprising the step of enhancing the dispersability of the oil prior to dispersing it throughout the slurry.

29. The process as claimed in claim 2 wherein the particles of coal have a size of no greater than about 28 mesh X 0.

30. The process as claimed in claim 3 wherein the particles of coal have a size of no greater than about 28 mesh X 0.

31. The process as claimed in claim 19, wherein the surfactant is selected from the group consisting of polydimethylsiloxane, lignansulphonates, eucalyptus oil, fatty acids having chain lengths of less than 15 carbon atoms, vegetable oil, and a mixture of propoxylated $C_{18}$ unsaturated fatty acids, trimethyl pentanediol monoisobutyrate, trimethyl pentanediol diisobutyrate and trimethyl pentanediol, and mixtures thereof and is present in a finite amount capable of performing its intended function up to an amount not exceeding about 0.25 kilograms for each tonne of dry coal.

32. The process as claimed in claim 20 wherein the surfactant is selected from the group consisting of polydimethylsiloxane, lignansulphonates, eucalyptus oil, fatty acids having chain lengths of less than 15 carbon atoms, vegetable oil, and a mixture of propoxylated $C_{18}$ unsaturated fatty acids, trimethyl pentanediol monoisobutyrate, trimethyl pentanediol diisobutyrate and trimethyl pentanediol, and mixtures thereof and is present in a finite amount capable of performing its intended function up to an amount not exceeding about 0.25 kilograms for each tonne of dry coal.

33. The process as claimed in claim 19 wherein the surfactant comprises oleic acid and is present in a finite amount capable of performing its intended function up to an amount not exceeding about 3.0 kilograms for each tonne of dry coal.

34. The process as claimed in claim 20 wherein the surfactant comprises oleic acid and is present in a finite amount capable of performing its intended function up to an amount not exceeding about 3.0 kilograms for each tonne of dry coal.

35. The process as claimed in claim 21 wherein the surfactant is present in a finite amount capable of performing its intended function up to an amount not exceeding about 0.25 kilograms for each tonne of dry coal.

36. The process as claimed in claim 22 wherein the surfactant is present in a finite amount capable of performing its intended function up to an amount not exceeding about 0.25 kilograms for each tonne of dry coal.

37. The process as claimed in claim 2 wherein the quantity of oil is present in a finite amount capable of performing its intended function up to an amount not exceeding about 2% by dry weight of coal.

38. The process as claimed in claim 3 wherein the quantity of oil is present in a finite amount capable of performing its intended function up to an amount not exceeding about 2% by dry weight of coal.

39. The process as claimed in claim 23 wherein the light oil that is blended with the oil is selected from the group consisting of used motor oil, diesel and kerosene.

40. The process as claimed in claim 24 wherein the light oil that is blended with the oil is selected from the group consisting of used motor oil, diesel and kerosene.

41. The process as claimed in claim 23 wherein the quantity of blended oil is present in a finite amount capable of performing its intended function up to an amount not exceeding about 2% by dry weight of coal.

42. The process as claimed in claim 24 wherein the quantity of blended oil is present in a finite amount capable of performing its intended function up to an amount not exceeding about 2% by dry weight of coal.

43. The process as claimed in claim 25 wherein the dispersability of the surfactant is enhanced by diluting, heating, or agitating it.

44. The process as claimed in claim 26 wherein the dispersability of the surfactant is enhanced by diluting, heating, or agitating it.

45. The process as claimed in claim 43 wherein the surfactant is diluted by the addition of a light oil.

46. The process as claimed in claim 44 wherein the surfactant is diluted by the addition of a light oil.

47. The process as claimed in claim 27 wherein the dispersability of the oil is enhanced by heating, agitating or emulsifying it.

48. The process as claimed in claim 28 wherein the dispersability of the oil is enhanced by heating, agitating or emulsifying it.

* * * * *

UNITED STATES PATENT AND TRADEMARK OFFICE

CERTIFICATE OF CORRECTION

PATENT NO. : 5,443,158

DATED : August 22, 1995

INVENTOR(S) : Colin J. McKENNY, et al.

It is certified that error appears in the above-identified patent and that said Letters Patent is hereby corrected as shown below:

At Column 2, line 35, change "10" to --C10--.

At Column 3, line 29, after "atoms" insert --a mixture of propoxylated C18 unsaturated fatty acids and trimethyl pentanediol monoisobutyrate and trimethyl pentanediol diisobutyrate and trimethyl pentanediol--.

At Column 8, line 66, after "Example #" insert --1--.

At Column 12, line 67, after "quantity" insert --of--.

At Column 14, line 12, after "function" insert --up--.

Signed and Sealed this

Second Day of January, 1996

Bruce Lehman

*Attest:*

BRUCE LEHMAN

*Attesting Officer*

*Commissioner of Patents and Trademarks*